US006865991B2

(12) United States Patent
Theurer

(10) Patent No.: US 6,865,991 B2
(45) Date of Patent: Mar. 15, 2005

(54) MACHINE AND METHOD FOR TAMPING A TRACK

(75) Inventor: Josef Theurer, Vienna (AT)

(73) Assignee: Franz Plasser Bahnbaumaschinen Industrie Gesellschaft mbH, Vienna (AT)

( * ) Notice: Subject to any disclaimer, the term of this patent is extended or adjusted under 35 U.S.C. 154(b) by 0 days.

(21) Appl. No.: 10/639,711

(22) Filed: Aug. 12, 2003

(65) Prior Publication Data

US 2004/0069180 A1 Apr. 15, 2004

(30) Foreign Application Priority Data

Sep. 25, 2002 (AT) ..... GM634/2002

(51) Int. Cl.[7] ..... E01B 27/00
(52) U.S. Cl. ..... 104/10
(58) Field of Search ..... 104/2, 10, 11, 104/12, 13

(56) References Cited

U.S. PATENT DOCUMENTS 3,343,497 A 9/1967 Stewart
4,090,451 A * 5/1978 Theurer ..... 104/12
4,476,786 A 10/1984 Theurer
5,706,734 A * 1/1998 Theuerer ..... 104/12
5,752,447 A * 5/1998 Theurer et al. ..... 104/12
6,389,979 B1 * 5/2002 Theurer et al. ..... 104/10

* cited by examiner

*Primary Examiner*—S. Joseph Morano
*Assistant Examiner*—Robert J. McCarry, Jr.
(74) *Attorney, Agent, or Firm*—Laurence A. Greenberg; Werner H. Stemer; Ralph E. Locher

(57) ABSTRACT

A machine is configured for tamping a track composed of rails that are fastened to ties resting on ballast. The rails extend in a longitudinal direction and have a field side and a gauge side, respectively, and the ballast forms tie supports located on the field side and the gauge side. The machine has a centerline extending in the longitudinal direction and comprises tamping units mounted opposite one another transversely of the longitudinal direction, each tamping unit having four tamping tine pairs composed of tamping tines and squeeze drives. The tamping tine pairs are arranged one following the other in the longitudinal direction and positioned, alternating in the longitudinal direction, at a shorter distance from the centerline for tamping tie supports located on the gauge side of the rails, and at a longer distance from the centerline for tamping tie supports located at the field side of the rails.

4 Claims, 2 Drawing Sheets

MACHINE AND METHOD FOR TAMPING A TRACK

BACKGROUND OF THE INVENTION

1. Field of the Invention

The present invention relates, in general, to a machine for tamping a track composed of rails fastened to ties resting on ballast, the rails extending in a longitudinal direction and having a field side and a gauge side, respectively, and the ballast constituting tie supports located on said field side and gauge side.

2. Description of the Related Art

My earlier, commonly assigned U.S. Pat. No. 5,706,734 describes a machine of this type, having a tamping unit with which three or five adjacent ties of a track may be tamped. To that end, five tamping tine pairs are positioned on either side of the rail, with three vibration drives being associated with the tamping tine pairs. Due to the close succession of the tamping tine pairs, however, problems may arise with regard to the unhindered vertical adjustment of the tamping tine pairs or the squeezing motion of the tamping tines. The latter have to be squeezed partly in two opposite directions.

It has become known from U.S. Pat. No. 3,343,497 (German patent DE 15 34 022) to Stewart to arrange two tamping tine pairs one behind the other for tamping three successive ties of a track.

SUMMARY OF THE INVENTION

It is an object of the present invention to provide a machine for tamping a track that overcomes the disadvantages of the heretofore-known devices and methods of this general type, and which provides an improved track tamping machine with which a total of four ties may be optimally tamped in a structurally simplified manner.

With the foregoing and other objects in view there is provided, in accordance with the present invention, a machine for tamping a track composed of rails fastened to ties resting on ballast, the rails extending in a longitudinal direction and having a field side and a gauge side, respectively, and the ballast constituting tie supports located on said field side and gauge side. The machine comprises a machine frame, supported by undercarriages for mobility on the track and having a centerline extending in the longitudinal direction; and tamping units mounted on the machine frame and lying opposite one another transversely of the longitudinal direction. Each tamping unit has, for simultaneously tamping four successive ties, four tamping tine pairs, each comprising two tamping tines and squeeze drives for squeezing the tamping tines together, the tamping tine pairs being arranged one following the other in the longitudinal direction and positioned, alternating in the longitudinal direction, at a shorter distance from the centerline for tamping tie supports located on the gauge side of the rail, and at a longer distance from the centerline for tamping tie supports located at the field side of the rail.

In accordance with an added feature of the invention, the tamping units further comprise vibration drives, and each squeeze drive is designed for carrying out a first squeezing motion leading away from the associated vibration drive, and for carrying out an oppositely directed second squeezing motion leading towards the vibration drive.

With the above and other objects in view there is also provided, in accordance with the invention, a method of simultaneously tamping four ties of a track by immersing tamping tines into ballast, the track including rails which extend in a longitudinal direction and have a gauge side and a field side, respectively, with any two adjacent ties defining a tie crib therebetween, wherein the tamping tines form tamping tine pairs, squeezable in the longitudinal direction by squeeze drives, for tamping tie supports. The novel method comprises the following steps:

with regard to each rail, four tamping tine pairs are centered alternatingly—as seen in the longitudinal direction—above tie supports adjoining the gauge side and tie supports adjoining the field side of the rail, the tamping tine pairs being staggered with regard to one another by one tie crib, wherein a respective rear tamping tine, with regard to a working direction, of a preceding tamping tine pair and a front tamping tine of the following tamping tine pair are arranged for immersion into the same tie crib, i.e., into a common crib;

in a first tamping operation, the tamping tines of each tamping tine pair are squeezed towards one another in a first tamping direction for tamping the tie lying therebetween in each case; and in a second tamping operation, the tamping tines are moved away from one another in a second tamping direction opposed to the first tamping direction.

In accordance with an added feature of the invention, there is provided a method of simultaneously tamping four ties of a track by immersing tamping tines into ballast, the track including rails which extend in a longitudinal direction and have a gauge side and a field side, respectively, with any two adjacent ties defining a tie crib therebetween, wherein the tamping tines form tamping tine pairs, squeezable in the longitudinal direction by squeeze drives, for tamping tie supports. The alternative method comprises the following steps:

with regard to each rail, a first group and a second group of four tamping tine pairs are centered alternatingly—as seen in the longitudinal direction—above tie supports adjoining the gauge side and tie supports adjoining the field side of the rail, the tamping tine pairs being staggered with regard to one another by one tie crib, wherein a respective rear tamping tine, with regard to a working direction, of a preceding tamping tine pair and a front tamping tine of the following tamping tine pair are arranged for immersion into the same tie crib;

in a first tamping operation, tie supports situated at the gauge side and tie supports situated at the field side are tamped, alternating in the longitudinal direction, by the first group of tamping tine pairs; and in a subsequent, second tamping operation, the remaining tie supports are tamped by the second group of tamping tine pairs.

A solution of this kind offers the advantage that it is now possible to space the tamping tine pairs further apart in the longitudinal direction, rather than having to arrange them following one another in close succession which would cause problems due to the resulting restriction of movement during the squeezing- and lowering motions. In spite of this loose arrangement, however, good tamping results can still be achieved as, in the case of tamping four successive ties, at least one tie support per rail can be tamped completely.

Other features which are considered as characteristic for the invention are set forth in the appended claims.

Although the invention is illustrated and described herein as embodied in a machine and a method for tamping a track, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE PREFERRED EMBODIMENTS

Figures 1, 2, 3:
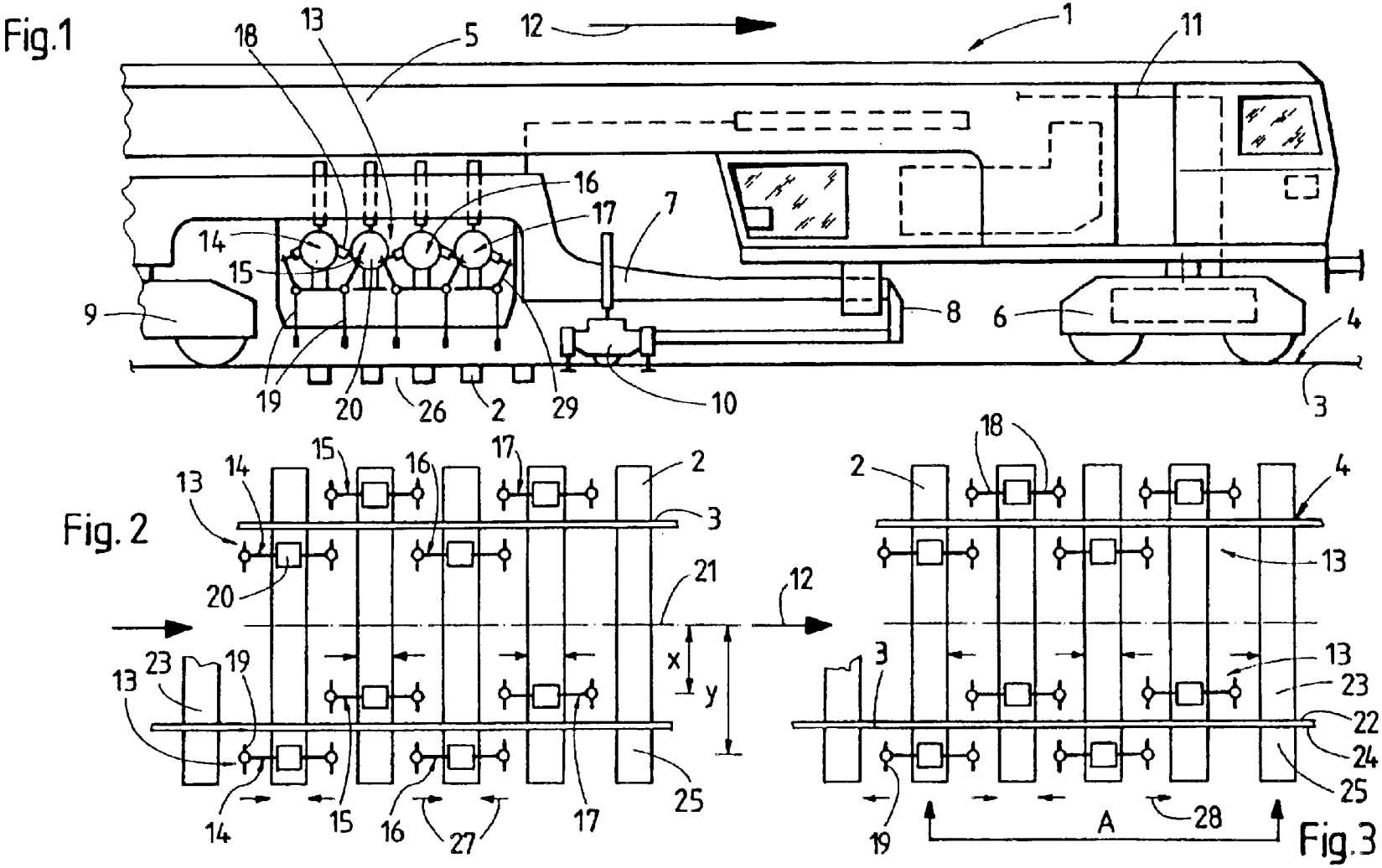
FIG. 1 is a partial side view of a machine for tamping a track.
FIG. 2 is a top view of the track, with schematically indicated tamping units carrying out a first tamping operation.
FIG. 3 is a top view of the track, with schematically indicated tamping units carrying out a second tamping operation.

Referring now to the figures of the drawing in detail and first, particularly, to FIG. 1 thereof, there is shown a side view of a portion of a machine 1 configured for tamping a track 4. The track is composed of rails 3, extending in a longitudinal direction. The rails 3 are successively fastened to track ties 2. Each rail 3 has a gauge side 22 and a field side 24 (see FIG. 3). The ties 2 rest on ballast which forms tie supports 23 positioned at the gauge side 22 of the rails 3, and tie supports 25 positioned at the field side 24 of the rails 3.

The machine 1 comprises a machine frame 5, extending in the longitudinal direction with regard to a centerline 21 of the machine as shown in FIG. 2. The machine frame 5 has undercarriages 6, arranged at the ends, for mobility of the machine 1 on the track 4. The machine frame 5 also includes a sub-frame 7, positioned between said undercarriages 6, which, at one end 8, is longitudinally displaceably linked to the machine frame 5 and, at the other end, is supported on the track 4 by means of a further undercarriage 9. A track lifting unit 10, in cooperation with a reference system 11, serves for correcting the position of the track 4. While, during working operations, the machine frame 5 advances continuously in a working direction indicated by reference numeral 12, the sub-frame 7 is stopped locally during each tamping procedure and subsequently moved swiftly forward relative to the machine frame 5 to the next tamping area for the following tamping procedure.

As is visible in more detail now also in FIGS. 2 and 3, two tamping units 13 are arranged on the machine 1 and spaced from one another transversely of the longitudinal direction, each tamping unit 13 being composed of four tamping tine pairs 14, 15, 16 and 17. Each tamping tine pair 14 to 17 consists of two tamping tines 19, squeezable in the longitudinal direction with the aid of squeeze drives 18, which may be set oscillating by means of a common vibration drive 20. Each tamping tine 19 is provided for immersion into a tie crib 26 formed by two adjacent ties 2.

As also becomes clear from FIGS. 2 and 3, the four tamping tine pairs 14 to 17 of each tamping unit 13 are arranged staggered in the longitudinal direction, being positioned, with regard to the centerline 21 of the machine 1, alternatingly at a shorter distance x and at a longer distance y therefrom. Accordingly, the tie supports 23 adjoining the gauge side 22 of the rail 3 can be tamped with those tamping tine pairs which are situated closer to the machine centerline 21, while the remaining tamping tine pairs are provided for compacting the tie supports 25 adjoining the field side 24 of the rail 3. The squeeze drives 18 are designed for carrying out a first squeezing motion leading away from the respective vibration drive 20 (see tamping direction 27 indicated by short arrows in FIG. 2) and for an oppositely directed second squeezing motion leading towards the vibration drive 20 (see tamping direction 28 indicated in FIG. 3).

A tamping cycle for simultaneously tamping four ties 2 is composed of two separate tamping operations and is carried out as follows:

In a first tamping operation (shown in FIG. 2), the two tamping tines 19 of each tamping tine pair 14 to 17 are moved towards one another (see tamping direction 27), so that the tie 2 lying therebetween is tamped in each case. Immediately thereafter, a second tamping operation takes place (shown in FIG. 3) in which the squeezing motion of the squeeze drives 18 is reversed to the opposite direction and thereby the tamping tines 19, immersed in the ballast, of each tamping tine pair 14 to 17 are moved away from one another (see tamping direction 28). Thus, the tie supports 23 or 25 of the tie 2 situated between two tamping tine pairs 14 to 17 is compacted in each case. During this, the front-most and rear-most tamping tines 19 of each tamping unit 13 only compact one half of the respective tie support 23 or 25. The other half of said tie support has either been tamped already in the previous tamping cycle or will be compacted in the next tamping cycle after the sub-frame 7 has been moved forward by a distance (A), equal to four times the tie distance.

Figure 4:
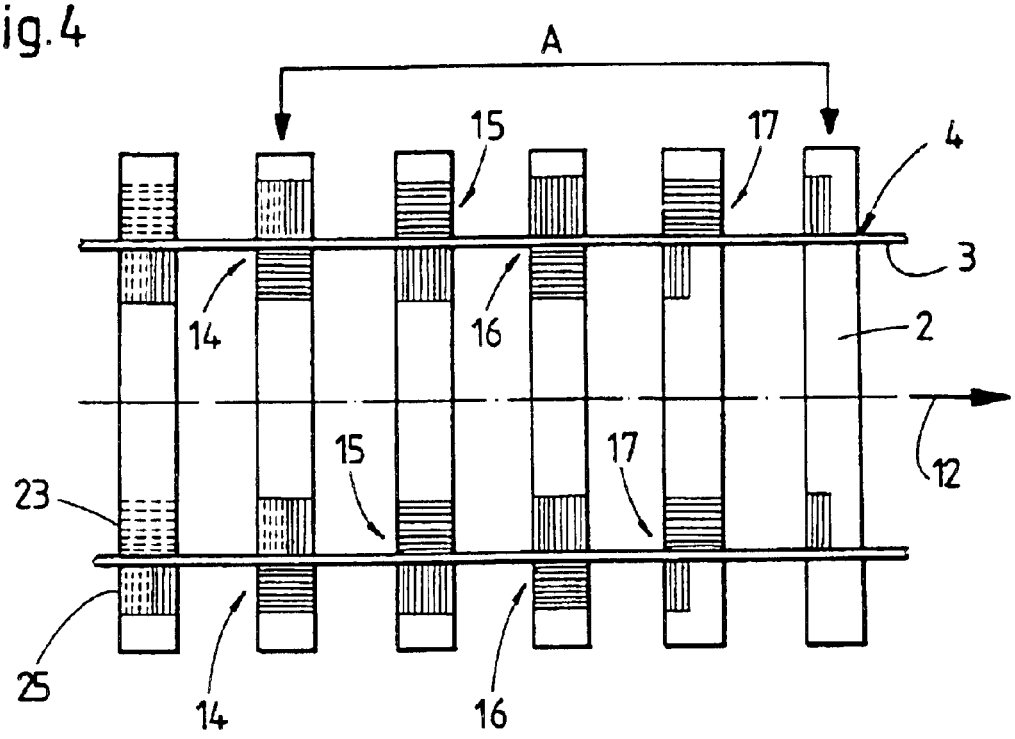
FIG. 4 is a further schematic top view of the track.

As shown in FIG. 4, a total of four tie supports 23 or 25 per rail 3 are compacted fully in the course of the first tamping operation (see horizontal hatch lines). In the subsequent second tamping operation, two tie supports 23,25 are tamped fully with a reciprocal tamping direction, and four tamping supports 23,25 are each tamped halfway (see vertical solid hatch lines). The dashed hatch lines indicate those half or fully tamped tie supports 23,25 which have already been compacted during the previous tamping cycle.

In the example illustrated in the drawing, the tamping units 13 have tamping levers 29, connected in each case to a squeeze drive 18, which typically only comprise a single tamping tine 19. If desired, however, it would also be possible to attach two tamping tines 19 to each tamping lever 29 as disclosed, for example, in my earlier, commonly assigned, U.S. Pat. No. 4,476,786. In accordance with the invention, it would also be possible to carry out the first tamping operation by a first and a second tamping unit lying opposite one another transversely to the longitudinal direction, and to carry out the second tamping operation by a third and a fourth tamping unit following behind in the working direction 12.

While the invention has been illustrated and described as embodied in a machine for tamping ties of a track, it is not intended to be limited to the details shown since various modifications and structural changes may be made without departing in any way from the spirit of the present invention.

I claim:

1. A machine for tamping a track composed of rails fastened to ties resting on ballast, the rails extending in a longitudinal direction and having a field side and a gauge side, respectively, and the ballast forming tie supports on the field side and tie supports on the gauge side, the machine comprising:

a machine frame supported by undercarriages for moving on the track and having a centerline extending in the longitudinal direction; and tamping units mounted to said machine frame opposite one another transversely to the longitudinal direction, each tamping unit having:

four tamping tine pairs for simultaneously tamping four successive ties and each comprising two tamping tines and squeeze drives for squeezing said tamping tines together, said tamping tine pairs being disposed one after another in the longitudinal direction and being positioned, in alternation in the longitudinal direction, at a shorter distance from the centerline for tamping the tie supports on the gauge side of the rail, and at a longer distance from the centerline for tamping the tie supports on the field side of the rail.

2. The machine according to claim 1, wherein said tamping units further comprise vibration drives, and each said squeeze drive is configured for carrying out a first squeezing motion leading away from the associated vibration drive, and for carrying out an oppositely directed second squeezing motion leading towards the vibration drive.

3. A method of simultaneously tamping four ties of a track by immersing tamping tines into ballast, the track including rails extending in a longitudinal direction and having a gauge side and a field side, respectively, with any two adjacent ties defining a tie crib therebetween, wherein the tamping tines form tamping tine pairs, squeezable in the longitudinal direction by squeeze drives, for tamping tie supports, the method which comprises the following steps:

with regard to each rail, alternatingly centering four tamping tine pairs, relative to the longitudinal direction, above tie supports adjoining the gauge side and tie supports adjoining the field side of the rail, wherein the tamping tine pairs are staggered with respect to one another by one tie crib;

thereby arranging a respective rear tamping tine, with regard to a working direction, of a preceding tamping tine pair and a front tamping tine of a following tamping tine pair for immersion into a common tie crib;

in a first tamping operation, squeezing the tamping tines of each tamping tine pair towards one another in a first tamping direction for tamping the tie lying therebetween in each case; and in a second tamping operation, moving the tamping tines away from one another in a second tamping direction opposite the first tamping direction.

4. A method of simultaneously tamping four ties of a track by immersing tamping tines into ballast, the track including rails extending in a longitudinal direction and having a gauge side and a field side, respectively, with any two adjacent ties defining a tie crib therebetween, wherein the tamping tines form tamping tine pairs, squeezable in the longitudinal direction by squeeze drives, for tamping tie supports, the method which comprises the following steps:

with regard to each rail, alternatingly centering a first group and a second group of four tamping tine pairs, relative to the longitudinal direction, above tie supports adjoining the gauge side and tie supports adjoining the field side of the rail, and staggering the tamping tine pairs relative to one another by one tie crib;

and thereby arranging a respective rear tamping tine, with regard to a working direction, of a preceding tamping tine pair and a front tamping tine of the following tamping tine pair for immersion into a common tie crib;

in a first tamping operation, tamping tie supports situated at the gauge side and tie supports situated at the field side, alternating in the longitudinal direction, by the first group of tamping tine pairs; and in a second tamping operation, subsequent to the first tamping operation, tamping remaining tie supports with the second group of tamping tine pairs.

* * * * *